US005137388A

United States Patent [19]

Kimura

[11] Patent Number: 5,137,388

[45] Date of Patent: Aug. 11, 1992

[54] LIQUID APPLICATOR HAVING A LOCKOUT VALVING POSITION

[75] Inventor: Masaru Kimura, Shinmachi, Japan

[73] Assignee: Mitsubishi Pencil Co., Ltd., Tokyo, Japan

[21] Appl. No.: 651,827

[22] Filed: Feb. 7, 1991

[30] Foreign Application Priority Data

Feb. 10, 1990 [JP] Japan ..... 2-12522[U]

[51] Int. Cl.[5] ..... A46B 11/04

[52] U.S. Cl. ..... 401/278; 401/273; 401/279; 401/283

[58] Field of Search ..... 401/273, 278, 279, 283

[56] References Cited

U.S. PATENT DOCUMENTS 1,138,772 5/1915 Matthews ..... 401/273

2,746,073 5/1956 Harris ..... 401/278 X

FOREIGN PATENT DOCUMENTS 2202429 9/1988 United Kingdom ..... 401/273

*Primary Examiner*—Steven A. Bratlie

*Attorney, Agent, or Firm*—Armstrong, Nikaido, Marmelstein, Kobovcik & Murray

[57] ABSTRACT

A liquid applicator according to the present invention includes an inner shaft as a liquid reservoir, an applying member, and a valve, wherein near the front end of the inner shaft there is provided a head portion which is non-circular in cross-section along the direction perpendicular to the axial line. At a position in front of the head portion of the inner shaft in an unknocked state, there is provided a controlling wall through which has been bored a through hole which is so designed that the head portion of the inner shaft can pass through the hole when it advances thereby keeping a position in a certain phase of the circumferential direction, while it cannot pass through that hole when keeping a position in another phase.

1 Claim, 4 Drawing Sheets

LIQUID APPLICATOR HAVING A LOCKOUT VALVING POSITION

BACKGROUND OF THE INVENTION

The present invention relates to an instrument for applying a liquid such as a hair dye liquid.

Heretofore, as shown in FIGS. 7 and 8, conventional hair dyeing instruments often incorporate an inner shaft reservoir for a hair dye liquid (not shown in the figure) that is housed in the interior of an outer shaft 2 so that it can be freely shifted in the axial direction. Between the inner shaft 1 and the brush 3 fixed at the front end of the outer shaft 2, a valve 4 is interposed allowing the inner shaft 1 to advance against the outer shaft 2 by pressing forward a knock shaft 5 disposed at the rear of the inner shaft 1. The valve 4 is opened so as to supply the hair dye liquid to the brush 3 from the inner shaft 1.

In liquid applicators of similar structure, in order to prevent the liquid from being unwillingly discharged in cases where the knock shaft 5 is accidentally knocked by dropping the applicator, as shown in the above-mentioned figures, means are adopted such that a projection 7 is provided at the inner edge portion of the opening of the tail plug 6 engaged on the rear end of the outer shaft 2. A longitudinal groove 8 in the axial direction and a transverse groove 9 in the circumferential direction into which the projection 7 can be fitted are provided on the outer surface portion of the knock shaft 5. When in use, by positioning the projection in the longitudinal groove, knocking can be done. When not in use, by rotating the knock shaft 5 so as to position the projection in the transverse groove 9, knocking is prevented.

However, the inner shaft 1 holding a liquid therein is so heavy to some degree that it often shifts position by itself on account of the force of inertia from its own weight in cases such as falling, etc. without being pressed by the knock shaft 5. Thus, it has been a disadvantageous point that the unwilling discharge of liquid is inevitable. Further, it has also been a shortcoming that since the provision of a longitudinal groove 8 or a transverse groove 9 on the outer surface portion of the knock shaft 5 compromises the external appearance of the instrument. They are undesirable from the viewpoint of design.

The object of the present invention is therefore to provide a liquid applicator that even when the inner shaft 1 has shifted its position by the force of inertia due to its own weight, the unwilling discharge of liquid can be prevented without compromising the external appearance of the instrument.

SUMMARY OF THE INVENTION

According to the present invention, a liquid applicator has an inner shaft reservoiring a liquid therein that is housed in the interior of an outer shaft so that it can be freely shifted in the axial direction. Between the inner shaft and the applying member, such as brush, and fixed at the front end of the outer shaft, a valve is interposed such that when the inner shaft is advanced against the outer shaft, the valve is opened so as to supply the liquid to the applying member from the inner shaft. The improvement of the present invention is directed to a head portion provided near the front end of the inner shaft which is non-circular in cross-section along a direction perpendicular to the axial line. At a position in front of the head portion of the inner shaft in an unknocked state, there is provided a controlling wall through which a through hole is bored and so designed that the head portion of the inner shaft can pass through the hole when it advances keeping a position in a certain phase of the circumferential direction, yet stopping the head portion from passing through the hole when keeping a position in another phase.

BRIEF EXPLANATION OF THE DRAWING

Of FIG. 1 through 6 which relate to the example of the present invention.

DETAILED DESCRIPTION AND THE PREFERRED EMBODIMENT

Figure 1:
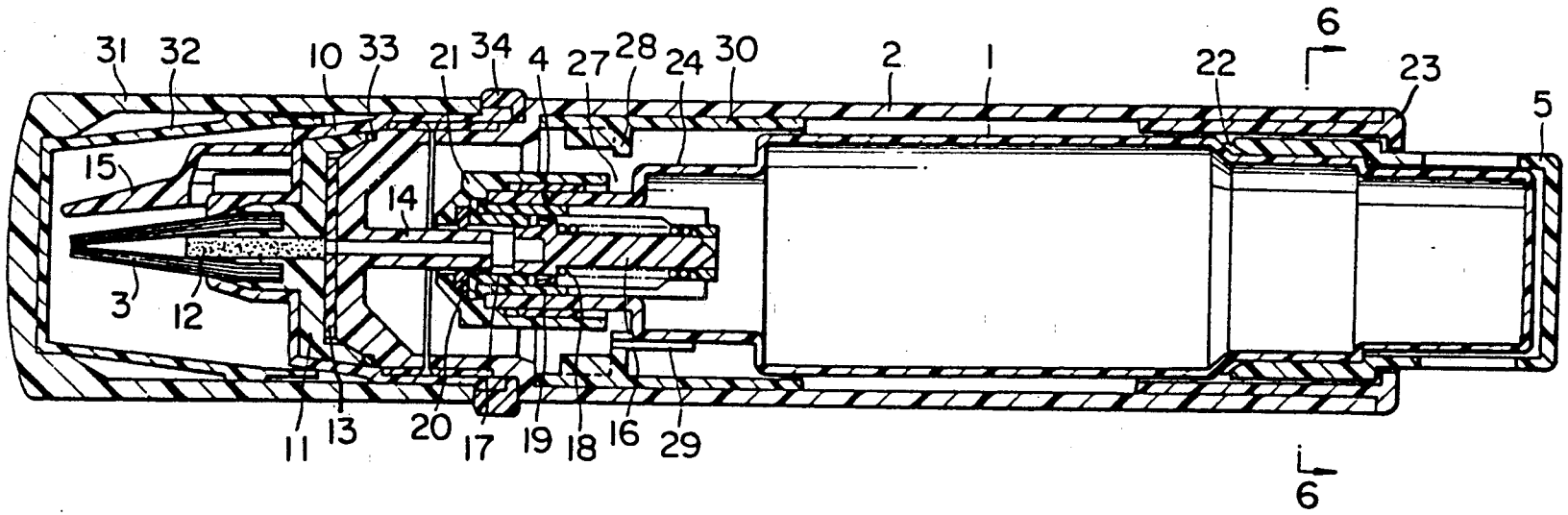
FIG. 1 is a longitudinal sectional view of the whole body.
Figure 2:
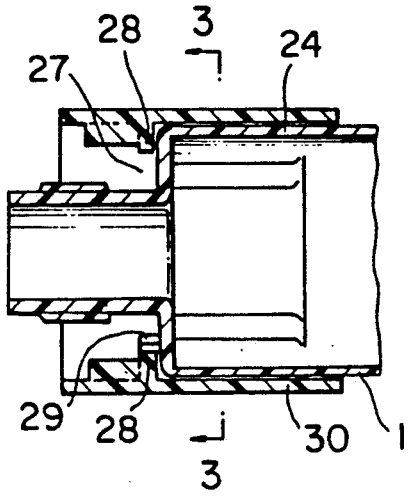
FIG. 2 is a longitudinal sectional view of the essential part showing such a state that the inner shaft has engaged on the stopper so that the head portion of the inner shaft cannot pass through the through hole.

Referring more particularly to the drawings, the outer shaft 2 has front shaft 10 screwed onto the front end thereof. In the interior of said front shaft 10 is fixed the basal part of the applying member on which brush 3 has been planted. In the central hole of the basal part is fitted sponge 12 which comes in contact with brush 3, and at the rear of said basal part 11 is fixed a liquid delivery tube 14, with the stopper 13 for the sponge being disposed therebetween. On the outer surface portion of the front end of the front shaft 10 is mounted a comb 15.

The inner shaft 1 within which a hair dye liquor (not shown in the figure) has been filled up is housed within the outer shaft 2 so that it can be freely shifted in the axial direction. A valve 4 is provided in the opening at the front of the inner shaft 1. The valve 4 comprises valve stem 16, valve seat 27, valve spring 18, and spring bearing 19. A cap 21 is screwed which has packing 20 fixed therein. The rear end of the above-described liquid delivery tube 14 is inserted through the central hole of the cap 21 in watertight contact with the packing 20, whereby the rear end of the liquid delivery tube 14 abuts against the front end of the valve stem 16. The knock shaft 5 is slipped on the outer peripheral portion of the inner shaft 1 and is designed in such a way that if the knock shaft 5 is engaged with a groove 22 provided in the axial direction of the inner shaft 1, when the knock shaft 6 is given a rotating operation, the inner shaft 1 also can rotate integrally with the knock shaft. In the above case, a breechblock 23 is press fitted which prevents the inner shaft 1 from slipping rearward. Further, a head portion 24 is provided at a position somewhat rearwardly of the cap 21 screwed onto the front end of the inner shaft 1. The head portion 24 having a cross-section along the direction vertical to the axial line is almost the shape of a koban (a Japanese gold coin used in former times); that is, both the side faces of the head portion are flattened, though the upper and lower surfaces are curved in the form of an circular arc. At the positions of both ends of the curved surfaces 25 of the head portion 24 are respectively provided stepped portions 26 (see FIG. 3). On the other hand, a controlling wall 28 is protrusively provided on the inner surface of the outer shaft 2 having a through hole 27 whose cross-section is almost similar to but slightly larger than that of the above-described head portion 24 of the inner shaft 1 in shape. A stopper 30 is also formed having ribs 29 which have been protrusively formed similarly on the inner surface thereof in the axial direction of from one end of the edge of the controlling wall 28 to the back. The stopper 30 is fixed on the inner surface of the outer shaft 2 so that the controlling wall 28 can be situated in front of the head portion 24 of the inner shaft which is in an unknocked state. Additionally, in FIG. 1, 31 is a cap, 32 an inner cap, 33 a seal ring, and 34 and ornamental ring.

Figure 5:
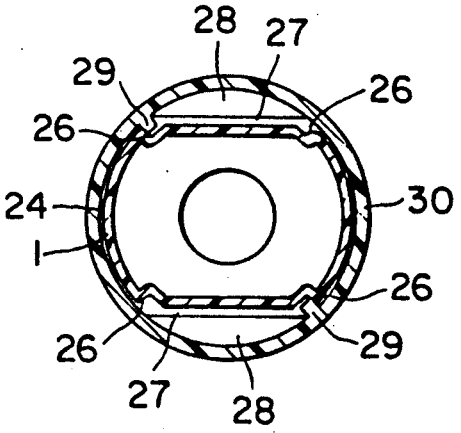
FIG. 5 is a cross-sectional view along the D—D line in FIG. 4.
Figure 6:
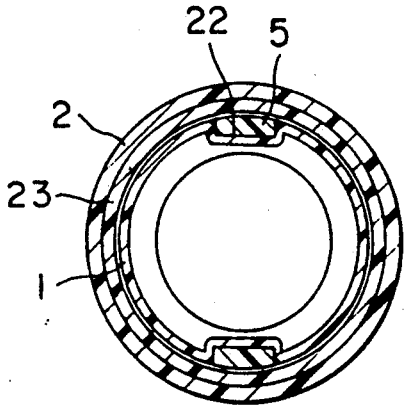
FIG. 6 is a cross-sectional view along the A—A line in FIG. 1.
Figure 8:
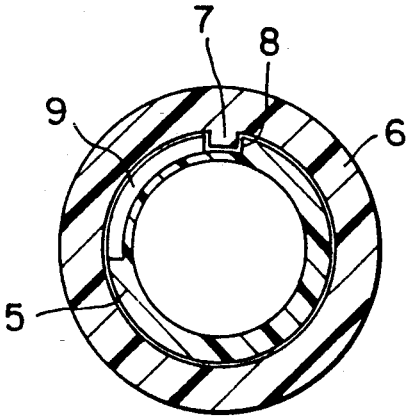
FIG. 8 PRIOR ART
FIG. 8 is a cross-sectional view along the B—B line in FIG. 7
Figure 7:
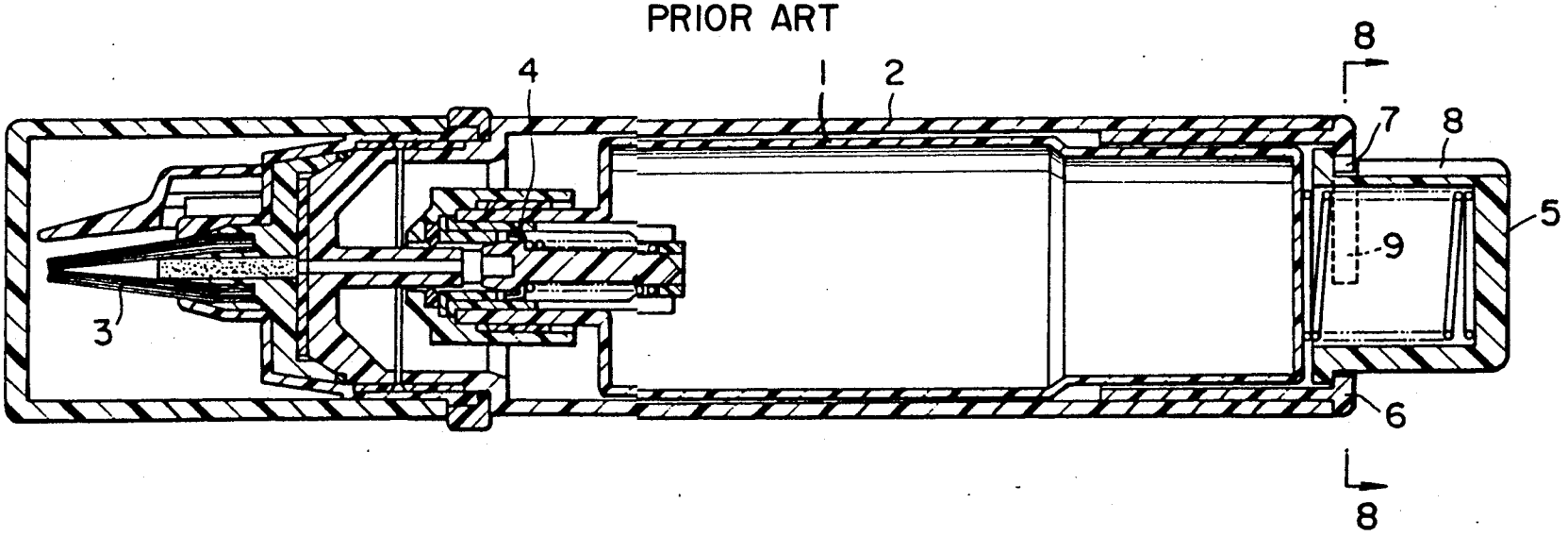
FIG. 7 PRIOR ART
FIG. 7 is a longitudinal sectional view of the whole body of a conventional example.

When the inner shaft 1 is rotated integrally with the knock shaft 5 by giving a rotating operation the knock shaft 5 so that the contour of the head portion 24 of the inner shaft 1 can enter the contour of the through hole 27 as shown in FIG. 5, if the knock shaft 5 is pressed forward the head portion 24 passes through the through hole 27 as shown in FIG. 5. If the knock shaft 5 is pressed forward, the head portion 24 passes through the through hole 27 allowing the inner shaft 1 to advance; but as the valve stem 16 abutting against the liquid delivery tube 14 cannot advance, it results that the valve stem 16 retreats relative to the valve seat 17. Thus, the valve 4 is opened rendering it possible that the hair dye liquid discharged from the inner shaft 1 is supplied to the brush 3 by passing through the liquid delivery tube 14 and the sponge 12. Furthermore, in the case where the inner shaft has been rotated, it is contemplated that the contour of the head portion 24 can just fit in the contour of the through hole 27 in such a state that the stepped portions 26 of the head portion 24 are engaged with the ribs 29 as shown in FIG. 5, whereby positioning is made by the stepped portions 26 and the ribs 29.

Figure 3:
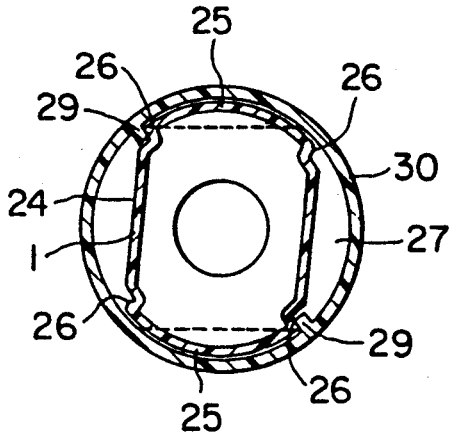
FIG. 3 is a cross-sectional view along C—C line in FIG. 2.
Figure 4:
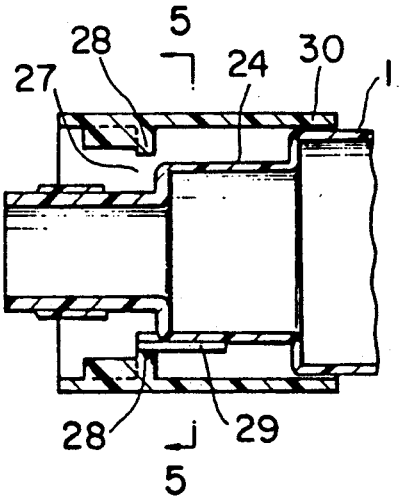
FIG. 4 is a longitudinal sectional view of the essential part showing such a state that the inner shaft has engaged on the stopper so that the head portion of the inner shaft can pass through the through hole.

Next, when the knock pressure is released so as to move the inner shaft 1 rearwardly by the restoring force of the valve spring 18 and the inner shaft 1 is rotated in the reverse direction in such a state that the head portion 24 is positioned in the rear of the through hole 27, the contour of the head portion 24 overruns the contour of the through hole 27 as shown in FIG. 3, so that even though the inner shaft 1 may advance by the force of inertia due to its own weight, it cannot advance, being hampered by the controlling wall 28. Accordingly, if such a state is assured when in use, the unwilling discharge of the hair dye liquid due to the advancement of the inner shaft 1 can be prevented. Furthermore, in such a case also, in view of the convenience in use, it is contemplated that positioning is made when the stepped portion 26 engages with the rib 29 as shown in FIG. 3.

The liquid applicator of the present invention is constructed as described above. Since in the present invention the inner shaft 1 has the head portion 24 whose cross-section is non-circular shape, and at a position in front of the head portion 24 in an unknocked state of the inner shaft is provided a controlling wall 28 through which has been bored a through hole 27 which can permit the passage therethrough of the head portion 24 at a position in a certain phase of the circumferential direction though it cannot permit the passage at a position in another phase, it has such an effect that when not in use the unwilling discharge of the liquid can be prevented by rotating the inner shaft 1 so as to hamper the advancement of the inner shaft 1 caused by the force of inertia due to its own weight. Also, since the knock shaft 5 requires no provision of the longitudinal groove 8 or the transverse groove 9 as in the above-described conventional examples, it has also such an effect that the compromising of the liquid applicator's external appearance can be eliminated.

What is claimed is:

1. In a liquid applicator having an inner shaft with a reservoir for a liquid, an outer shaft with an interior housing the inner shaft so that the inner shaft can be freely shifted in an axial direction, between said inner shaft an applying member fixed at a front end of the outer shaft, a valve located between the inner shaft and the applying member and operates so as to open and thereby supply the liquid to the applying member from the inner shaft when the inner shaft is advanced against the outer shaft, the improvement comprising:

a head portion located near a front end of the inner shaft and being non-circular in cross-section along a direction perpendicular to axial line of the liquid applicator; and a controlling wall located on the outer shaft through which is defined a through hole so that said head portion of the inner shaft can pass through said hole when the inner shaft advances into a knocked state, thereby maintaining the inner shaft in a position along a first certain phase in a circumferential direction of the outer shaft, said head portion not being able to pass through said hole when the inner shaft is maintained in a position along a second certain phase in the circumferential direction of the outer shaft, and thereby retaining the inner shaft in an unknocked state.

* * * * *